US006499967B2

(12) United States Patent
Hansen

(10) Patent No.: US 6,499,967 B2
(45) Date of Patent: Dec. 31, 2002

(54) SHAFT AXIAL COMPLIANCE MECHANISM

(75) Inventor: Chris Duane Hansen, Chattanooga, TN (US)

(73) Assignee: Tecumseh Products Company, Tecumseh, MI (US)

( * ) Notice: Subject to any disclaimer, the term of this patent is extended or adjusted under 35 U.S.C. 154(b) by 26 days.

(21) Appl. No.: 09/849,541

(22) Filed: May 4, 2001

(65) Prior Publication Data

US 2002/0164256 A1 Nov. 7, 2002

(51) Int. Cl.[7] ..... F04B 35/00; F04B 35/04
(52) U.S. Cl. ..... 417/365; 417/410.5
(58) Field of Search ..... 417/365, 321, 417/410.1, 410.5, 423.12, 405; 384/903

(56) References Cited

U.S. PATENT DOCUMENTS

| | | | | |
|---|---|---|---|---|
| 1,394,019 A | | 10/1921 | Jensen | 403/355 |
| 2,629,615 A | | 2/1953 | Marsilius | 403/355 |
| 2,938,698 A | | 5/1960 | Johnson | 248/314 |
| 3,006,671 A | | 10/1961 | Opocensky | 403/265 |
| 3,584,517 A | | 6/1971 | Tomlinson | 74/473.21 |
| 3,841,672 A | | 10/1974 | Schultz et al. | 285/148.21 |
| 4,643,279 A | | 2/1987 | Skurka | 188/79.55 |
| 4,946,353 A | * | 8/1990 | Crofoot | 417/410.5 |
| 5,116,072 A | | 5/1992 | Swenson | 280/511 |
| 5,505,595 A | * | 4/1996 | Fukui | 418/55.1 |
| 5,579,661 A | | 12/1996 | Yarnell et al. | 74/473.29 |
| 5,617,763 A | | 4/1997 | Cymbal | 74/552 |
| 5,779,283 A | | 7/1998 | Kimura et al. | 285/305 |

* cited by examiner

*Primary Examiner*—Charles G. Freay
*Assistant Examiner*—Michael K. Gray
(74) *Attorney, Agent, or Firm*—Baker & Daniels

(57) ABSTRACT

A hermetic compressor assembly including a housing having mounted therein a motor and a compression mechanism which are operatively coupled by a drive shaft. The drive shaft is rotatably received in a bearing mounted in the housing. Engaging means are provided in the drive shaft and the bearing to prevent relative movement between the compression mechanism and the drive shaft in both directions along the drive shaft axis of rotation. The engaging means includes a circumferential groove provided in the drive shaft, a bore located in the bearing, and a retaining element may be in the form of a ball or an elongate pin. The circumferential groove and the bore are aligned and each receive a portion of a retaining element to prevent axial movement of the drive shaft.

29 Claims, 2 Drawing Sheets

SHAFT AXIAL COMPLIANCE MECHANISM

BACKGROUND OF THE INVENTION

The present invention relates to hermetic compressors and particularly to compressors having substantially horizontal drive shafts.

Hermetic compressors generally include a hermetically sealed housing in which a compression mechanism and an electric motor are disposed. The motor is coupled to the compression mechanism via a drive shaft. A substantially horizontal hermetic compressor is one in which the shaft axis of rotation and thus the drive shaft of the compressor are nearly horizontal. Electrical power is provided to the motor through a hermetic terminal assembly to induce rotation of the drive shaft. Rotation of the drive shaft induces rotation of the compression mechanism to compress refrigerant fluid in the compression mechanism and discharge refrigerant gas to a refrigeration system.

In horizontal compressors, the weight of the drive shaft and the rotor does not urge the drive shaft along its axis of rotation into a position in which the drive shaft is in abutting relationship with a thrust bearing surface. During operation of the compressor, the rotation of the rotor, drive shaft, and compression mechanism may generate oscillating axial movement of the drive shaft. Objectionable noise, such as knocking, often accompanies such back and forth oscillation of the drive shaft.

One method of biasing the rotor and the drive shaft in one direction along the longitudinal axis of rotation is by using the solenoid effect of the motor. The stator and the rotor of the motor are offset by a specific distance, and upon energization of the stator the rotor is urged in a direction to allow alignment of its laminae with those of the stator. The rotor exerts an axial force on the drive shaft, moving the drive shaft into engagement with a thrust bearing surface to maintain axial compliance of the drive shaft during compressor operation. Axial positioning of the rotor and stator must be closely toleranced.

Another method which may be employed to prevent axial oscillations of the drive shaft is to construct the compressor to have close tolerances and selective fits. This limits the available space in which the drive shaft may move and thereby limits axial movement of the drive shaft. By limiting the axial movement of the drive shaft, the amount of noise produced by oscillating axial movement of the drive shaft is reduced.

A problem with these methods of providing axial compliance of a horizontal drive shaft is that gaging and selective assembly of compressor components is labor intensive. Further, manufacturing processes for compressor components having close tolerances are more difficult and thus more expensive.

It is desirable to provide a shaft axial compliance mechanism for a substantially horizontal hermetic compressor which avoids selective fits and close tolerances to prevent objectionable noise created by oscillating axial movement of the drive shaft during compressor operation.

SUMMARY OF THE INVENTION

The present invention provides a shaft compliance mechanism for a substantially horizontal hermetic compressor to prevent objectionable noise created by oscillating axial movement of the drive shaft without resorting to close machining tolerances or selective assembly of components.

The drive shaft of a substantially horizontal hermetic compressor is provided with a circumferential groove near one end of the shaft. A bore is provided in the outboard bearing of the compressor which is aligned with the circumferential groove in the drive shaft. A retaining element such as a ball or an elongated pin is placed in the bore such that a portion of the retaining element is located within the bore and a portion of the retaining element is located in the shaft circumferential groove to prevent relative axial movement of the drive shaft.

The present invention provides a hermetic compressor assembly including a housing having mounted therein a compression mechanism and a motor which are operatively coupled by a drive shaft having a substantially horizontal axis of rotation. A bearing is disposed in the housing, is fixed relative to the compression mechanism and is disposed about the drive shaft. The drive shaft is provided with a circumferential groove in the outer surface thereof. A drive shaft retaining element is located in a bore located in the bearing with a first portion of the retaining element engaging the bore, and a second portion of the retaining element received in and engaging the circumferential groove. Relative movement of the drive shaft in both directions along the drive shaft axis of rotation is thereby prevented.

The present invention also provides a hermetic compressor assembly including a housing having a compression mechanism and a motor disposed therein. A drive shaft having an axis of rotation which is substantially horizontal operatively couples the compression mechanism and the motor. A bearing is disposed in the housing, is fixed relative to the compression mechanism and is disposed about the drive shaft. Further provided are means for engaging the drive shaft and the bearing to prevent relative movement between the compression mechanism and the drive shaft in both directions along the drive shaft axis of rotation.

The present invention also provides a hermetic compressor assembly including a housing having disposed therein a compression mechanism and a motor operatively coupled by a drive shaft. The drive shaft, having an axis of rotation which is substantially horizontal, has an outer surface in which a circumferential groove is provided. A bearing is disposed in the housing, is fixed relative to the compression mechanism and is disposed about the drive shaft. A ball is retained in a bore provided in the bearing such that a portion of the ball is received in and engages the shaft circumferential groove to prevent relative movement between the compression mechanism and the drive shaft in both directions along the drive shaft axis of rotation.

The present invention also provides a hermetic compressor assembly including a housing having disposed therein a compression mechanism and a motor operatively coupled by a drive shaft. The drive shaft has an outer surface in which a circumferential groove is provided and an axis of rotation which is substantially horizontal. A bearing is disposed in the housing, is fixed relative to the compression mechanism and is disposed about the drive shaft. The bearing is provided with a bore in which a pin is received. A portion of the pin is received in and engages the shaft circumferential groove to prevent relative movement between the compression mechanism and the drive shaft in both directions along the drive shaft axis of rotation.

The present invention provides a method of preventing oscillating axial movement of a substantially horizontal drive shaft during operation of a hermetic compressor. The method includes forming a circumferential groove in the drive shaft and rotatably supporting the drive shaft in a bearing. Further included is forming a bore in the bearing and aligning the bore and the circumferential groove. The method also includes engaging the bore and the circumferential groove each with a portion of a retaining element.

One advantage provided by the shaft axial compliance mechanisms of the present invention is that the tolerances of the compressor may be looser and selective component assembly is not required to provide axial compliance of the horizontal drive shaft. Further, the inventive axial compliance mechanism may be incorporated with only minor design and process revisions, and with only minimal increases in labor.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
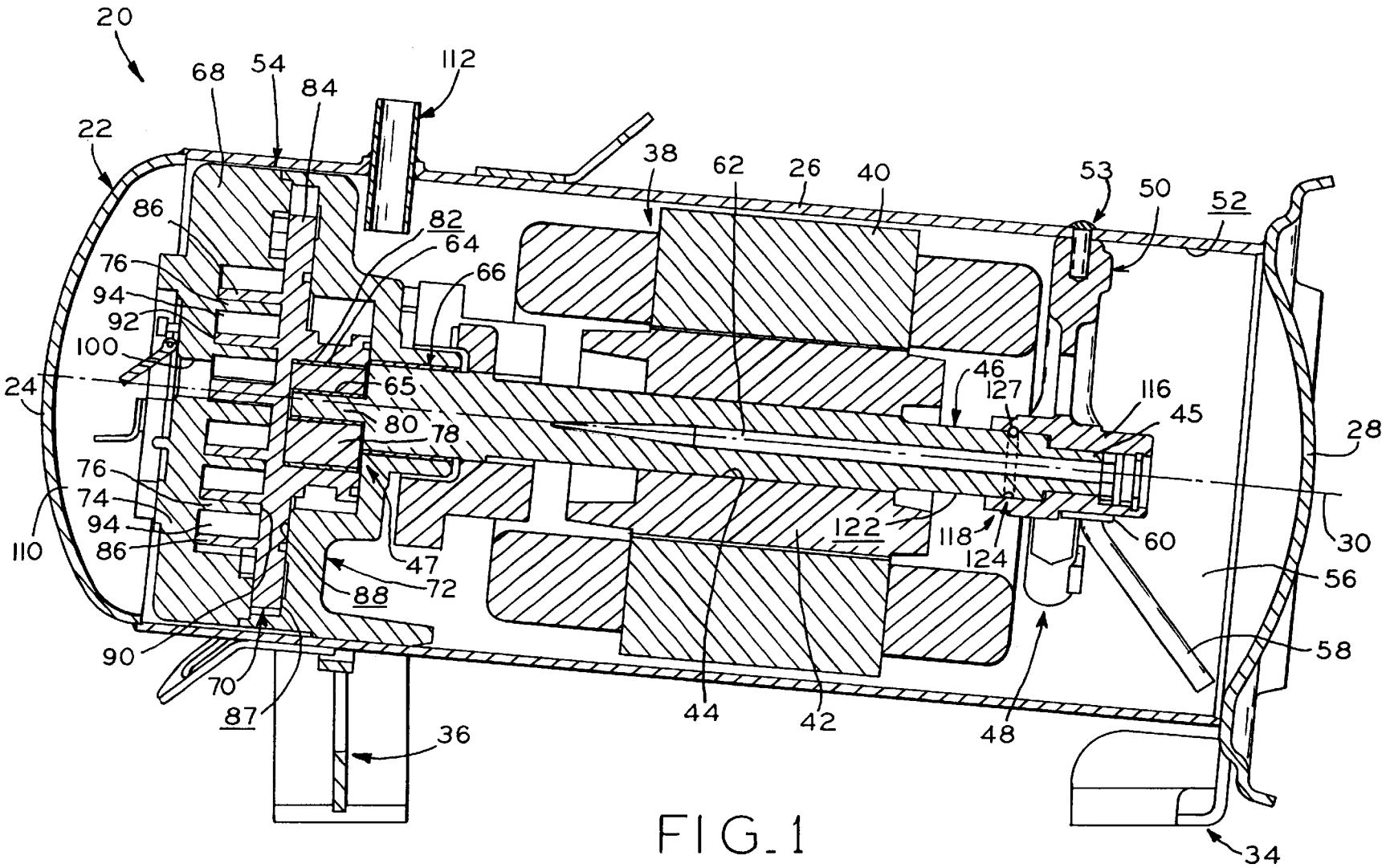
FIG. 1 is a sectional side view of a compressor assembly in accordance with a first embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE INVENTION

Referring to FIG. 1, hermetic compressor assembly 20 includes housing 22 having end portions 24 and 28 with central portion 26 located therebetween. Housing portions 24, 26, and 28 are hermetically sealed by any suitable process including welding, brazing, or the like. Compressor 20 is arranged substantially horizontally and is supported by mounting bracket 34 and stand 36 located at opposite ends of housing 22. One end of compressor housing 22 may be slightly higher than the other to influence the flow of oil toward oil sump 56 within housing 22.

Figure 3:
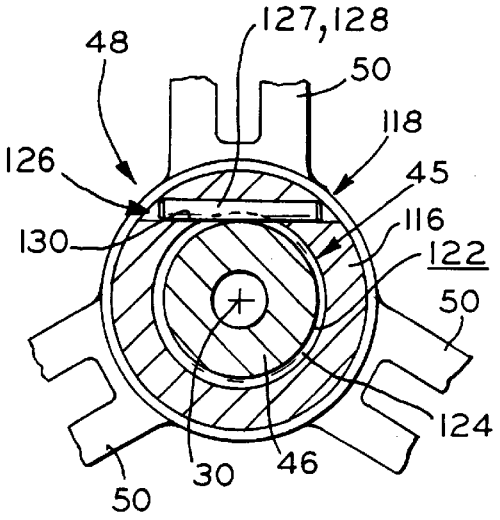
FIG. 3 is a sectional view of the compressor assembly of FIG. 2 along line 3—3.
Figure 5:
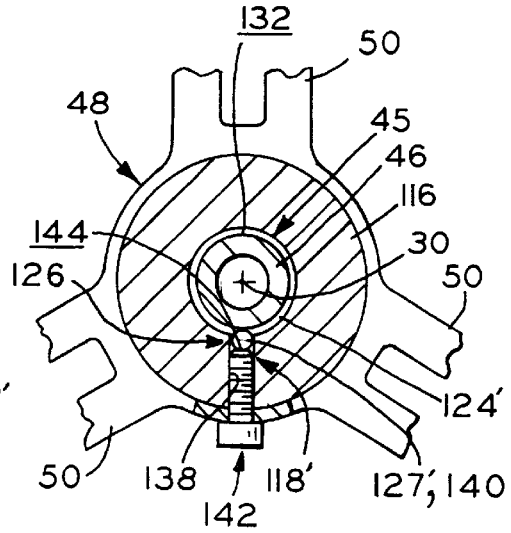
FIG. 5 is a sectional view of the compressor assembly of FIG. 4 along line 5—5.

Disposed within housing 22 is electric motor 38 including stator 40 and rotor 42. Located centrally in rotor 42 is aperture 44 into which drive shaft 46 is interference fitted. End 45 of drive shaft 46 is rotatably supported in outboard bearing 48 mounted near the end of central housing portion 26 secured to housing portion 28. Outboard bearing 48 is provided with three legs 50 radially extending from collar 116 (FIGS. 1, 3, and 5). Legs 50 are secured to inner surface 52 of central housing portion 26 by weld pins 53 which extend through central housing portion 26 into each leg 50 (FIG. 1).

Operatively coupled to end 47 of drive shaft 46 is compression mechanism 54. Oil is conveyed from sump 56 through oil pick-up tube 58 which extends from plate 60 secured to collar 116 of outboard bearing 48. During compressor operation, oil is drawn upwardly through pick-up tube 58 into oil passageway 62 which extends longitudinally through drive shaft 46. The lubricating oil travels along passageway 62 to end 47 of drive shaft 46 to be delivered to compression mechanism 54, and bearings 64, 65, and 66.

Although compressor 20 is illustrated as a scroll type compressor, the present invention may be suitably adapted to any other type of compressor, such as, e.g., a rotary compressor. The general operation of a scroll compressor is described in U.S. Pat. Nos. 5,306,126 and 6,015,277, the disclosures of which are hereby expressly incorporated herein by reference. The general operation of a rotary compressor is described in U.S. Pat. No. 5,222,885, the disclosure of which is hereby expressly incorporated herein by reference. Scroll compressor mechanism 54 includes fixed scroll member 68, orbiting scroll member 70, and main bearing frame member 72. Fixed scroll member 68 is secured to main bearing frame member 72 by any suitable method including mounting bolts. Fixed scroll member 68 includes flat plate 74 having scroll wrap 76 extending approximately perpendicularly therefrom. Orbiting scroll member 70 is fixedly mounted to roller 78 which is secured to offset crank pin 80 formed at end 47 of drive shaft 46. Bearing 64 is disposed between the outer surface of roller 78 and surface 82 of orbiting scroll member 70. Orbiting scroll member 70 includes flat plate 84 having scroll wrap 86 extending approximately perpendicularly therefrom. Scroll mechanism 54 is assembled such that fixed scroll wrap 76 and orbiting scroll wrap 86 intermesh with back surface 87 of flat plate 84 engaging main bearing member 72 at thrust bearing surface 88 when the compressor is in a de-energized or inoperative state.

During compressor operation, motor 38 is energized which induces rotation of rotor 42 and thus drive shaft 46. Surrounding offset crank pin 80 is cylindrical roller 78 which rotates with drive shaft 46 to generate rotation of orbiting scroll member 70 with respect to fixed scroll member 68. A biasing force acts upon orbiting scroll member 70 to move it axially toward fixed scroll member 68 so that tips 90 and 92 of scroll wraps 76 and 86 sealingly engage face plates 84 and 74, respectively, to define a plurality of compression chambers 94.

Refrigerant fluid at suction pressure is drawn into compression chambers 94 from a refrigeration system (not shown). As orbiting scroll member 70 is rotated with respect to fixed scroll member 68, refrigerant fluid captured within compression chambers 94 is compressed to discharge pressure. The refrigerant fluid progresses radially inwardly toward discharge port 100 located in fixed scroll member 68. The fluid flows through discharge port 100 into discharge chamber 110 which occupies the interior of compressor housing 22. The discharge pressure fluid is then exhausted through discharge tube 112 back into the refrigeration system.

During compressor operation, rotation of drive shaft 46 and compressor mechanism 54 may produce axial movement of drive shaft 46. In a substantially vertically oriented compressor, gravity acts axially along the axis of rotation of the drive shaft and the rotor to maintain seating of the drive shaft with respect to the outboard bearing. In a substantially horizontally arranged compressor 20, gravity does not influence axial movement of drive shaft 46. Oscillating axial movement of drive shaft 46 produces objectionable noise, such as knocking, during compressor operation. In order to counteract these movements of drive shaft 46, a shaft axial compliance mechanism in accordance with the present invention is provided.

Referring to the figures, end 45 of drive shaft 46 is rotatably supported within central collar 116 of outboard bearing 48. Shaft axial compliance mechanism 118 prevents relative movement between compression mechanism 54 and drive shaft 46 in both directions along shaft axis of rotation 30 by engaging drive shaft 46 and outboard bearing 48. The inventive shaft axial compliance mechanism comprises engaging means which includes a circumferential groove, a retaining element, and a bore located in outboard bearing 48.

The circumferential groove is formed in a cylindrical outer surface of drive shaft 46 and receives a portion of the retaining element. The circumferential groove may be manufactured using any suitable process to have a substantially semicircular or V-shaped cross section. The bore is located in collar 116 of outboard bearing 48 and is aligned with the groove. The retaining element is received in the bore and the shaft circumferential groove to couple them together and prevent relative axial movement therebetween. The inventive engaging means thereby provides axial compliance of drive shaft 46 as will be described hereinbelow.

Figure 2:
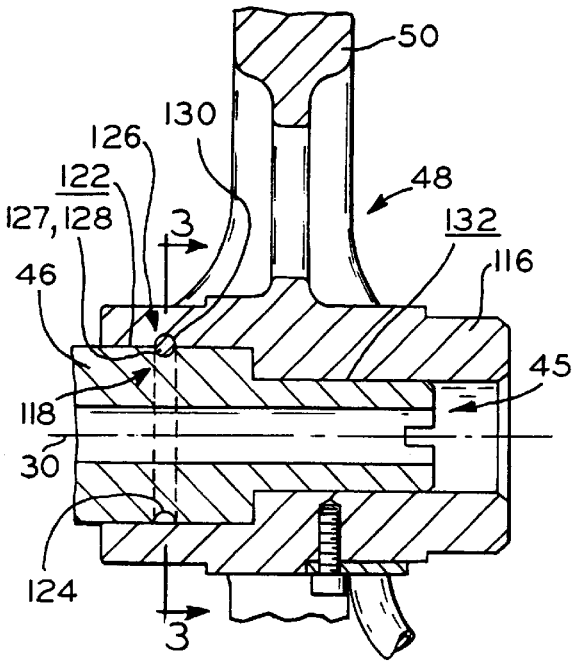
FIG. 2 is a fragmentary sectional view of the compressor assembly of FIG. 1.

In a first embodiment, shaft axial compliance mechanism 118 illustrated in FIGS. 1, 2 and 3 includes retaining element 127 which is in the form of dowel pin or rolled pin 128 (FIG. 3). Pin 128 may be constructed from any suitable material possessing shear strength characteristics able to prevent axial movement of drive shaft 46 and accommodate relative movement between pin 128 and shaft 46. In one embodiment, pin 128 is constructed from steel and has a diameter of approximately one-eighth inch. Collar 116 of bearing 48 is provided with bore 130 which may be drilled or cast into collar 116. Bore 130 extends approximately tangentially to outer surface 122 of drive shaft 46, and extends approximately perpendicularly to shaft axis of rotation 30 (FIG. 3). Bore 130 has approximately the same diameter as pin 128 such that pin 128 may be interference fitted into bore 130.

Pin 128 is in sliding contact with the surfaces defining circumferential groove 124, which is formed in shaft surface 122. A portion of bore 130 overlaps circumferential groove 124 such that the alignment of groove 124 and bore 130 allows a portion of pin 128 to be disposed within groove 124 and a portion of pin 128 to be disposed in bore 130. Axial movement of drive shaft 46 in either direction of along shaft axis of rotation 30 is thereby prevented. Groove 124 is illustrated in FIGS. 1–3 as having a semicircular cross section, but may instead have a V-shaped cross section.

Figure 4:
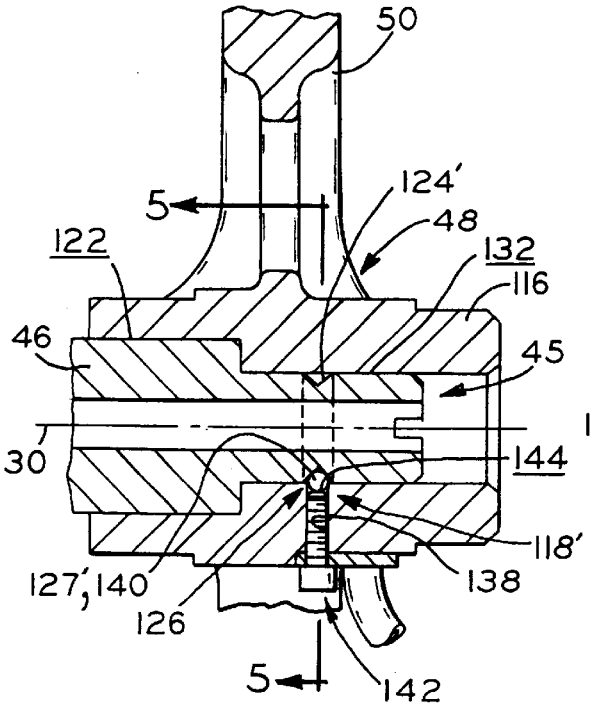
FIG. 4 is a fragmentary sectional view of a compressor assembly in accordance with a second embodiment of the present invention.

Referring to FIGS. 4 and 5, a second embodiment of the inventive shaft axial compliance mechanism is shown. In shaft axial compliance mechanism 118', circumferential groove 124' is provided in cylindrical outer surface 132 provided near end 45 drive shaft 46. Groove 124' is illustrated in FIG. 4 as having a V-shaped cross section, but may instead have a semicircular cross section.

Central collar 116 of outboard bearing 48 is provided with bore 138 which extends substantially radially from shaft axis of rotation 30. Bore 138 may be formed in outboard bearing 48 by any suitable method including being drilled or cast therein. Bore 138 may also be used to removably attach oil pick-up tube 58 to collar 116 as will be discussed hereinbelow. Retaining element 127' of second embodiment shaft axial compliance mechanism 118' is in the form of ball 140 which is received in bore 138. Ball 140 is constructed from any suitable material having shear strength characteristics able to prevent axial movement of drive shaft 46 during compressor operation and accommodate relative movement between ball 140 and shaft 46. In one embodiment, ball 140 has a diameter of one-eighth inch and is made of steel. Plug 142 is threaded into bore 138 until end surface 144 of plug 142 is in contact with ball 140'. Plug 142 may be any suitable fastener, such as a screw. Plug 142 maintains the position of ball 140 such that portions of ball 140 remain in circumferential groove 124 and in bore 138. Shaft axial compliance mechanism 118' thereby maintains the axial position of shaft 46 and prevents its oscillating along axis of rotation 30.

Oil pick-up tube 58 mounted to plate 60 (FIG. 1) may be provided to convey oil from sump 56 to oil passageway 62. Plate 60 may be removably secured to collar 116 of outboard bearing 48 by a fastener such as plug 142 (FIGS. 4 and 5), which is threaded into bore 138 of shaft axial compliance mechanism 118'. By utilizing plug 142 as the fastener for oil pick-up tube 58 and for maintaining ball 140 in circumferential groove 124', there is no need to provide an additional bore 138 in collar 116.

Further, it is to be understood that in either embodiment of the inventive shaft axial compliance mechanism, circumferential shaft groove 124, 124' may be located in either of surfaces 122 or 132, with bore 130, 138 located in alignment therewith as described above. Generally, it is beneficial to provide the groove in the smallest diameter cylindrical surface which, as shown, is surface 132.

Shaft axial compliance mechanisms 118 and 118' provide a simple, inexpensive device which eliminates oscillating axial movement of drive shaft 46 in substantially horizontally oriented compressor 20, maintains proper alignment of drive shaft 46 relative to compression mechanism 54, and helps to prevent objectionable noise, such as knocking, during compressor operation.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hermetic compressor assembly comprising:

a compressor housing;

a compression mechanism disposed in said housing;

a motor disposed in said housing;

a drive shaft operatively coupling said compression mechanism and said motor, said drive shaft having an outer surface in which a circumferential groove is provided, and an axis of rotation which is substantially horizontal;

a bearing disposed in said housing and fixed relative to said compression mechanism, said bearing disposed about said drive shaft, said bearing provided with a bore; and a drive shaft retaining element disposed in said bore, a first portion of said retaining element engaging said bore, and a second portion of said retaining element received in and engaging said circumferential groove, whereby relative movement of said compression mechanism and said drive shaft in both directions along said drive shaft axis of rotation is prevented.

2. The hermetic compressor of claim 1, wherein said drive shaft retaining element is a ball.

3. The hermetic compressor of claim 2, wherein said ball is substantially spherical, approximately one-half of said ball extending into said circumferential groove.

4. The hermetic compressor of claim 2, further comprising a plug disposed in said bore, the movement of said ball along said bore being limited by said plug.

5. The hermetic compressor of claim 4, wherein said bore and said plug are threadedly engaged.

6. The hermetic compressor of claim 4, wherein said plug is a screw, and further comprising an oil pick-up tube, said oil pick-up tube being attached to said bearing by said screw.

7. The hermetic compressor of claim 1, wherein said bore extends substantially radially from said shaft axis of rotation.

8. The hermetic compressor of claim 1, wherein a cross section of said circumferential groove is semicircular.

9. The hermetic compressor of claim 1, wherein a cross section of said circumferential groove is substantially V-shaped.

10. The hermetic compressor of claim 1, wherein said bearing is attached to said housing.

11. The hermetic compressor of claim 1, wherein said motor is disposed between said bearing and said compression mechanism.

12. The hermetic compressor of claim 1, wherein said drive shaft retaining element is an elongate pin.

13. The hermetic compressor of claim 12, wherein said pin extends through said bore, a portion of said pin being received in and engaging said circumferential groove.

14. The hermetic compressor of claim 12, wherein said bore is substantially linear and extends substantially perpendicularly relative to said drive shaft axis of rotation.

15. The hermetic compressor of claim 14, wherein said pin is substantially cylindrical and has a diameter, a portion of said pin being disposed within said circumferential groove.

16. The hermetic compressor of claim 14, wherein said pin is interference-fitted into said bore.

17. The hermetic compressor of claim 14, wherein a portion of the surface of said bore is continuous along its length.

18. The hermetic compressor of claim 12, wherein said pin is one of a roll pin and a dowel pin.

19. A hermetic compressor assembly comprising:

a compressor housing;

a compression mechanism disposed in said housing;

a motor disposed in said housing;

a drive shaft operatively coupling said compression mechanism and said motor, said drive shaft having an axis of rotation which is substantially horizontal;

a bearing disposed in said housing and fixed relative to said compression mechanism, said bearing disposed about said drive shaft; and means for engaging said drive shaft and said bearing and preventing relative movement between said compression mechanism and said drive shaft in both directions along said drive shaft axis of rotation.

20. The hermetic compressor of claim 19, wherein said drive shaft has an outer surface, and said means includes a circumferential groove provided in said drive shaft outer surface, and one of a ball and a pin retained by said bearing and partially received in said circumferential groove.

21. The hermetic compressor of claim 20, wherein said bearing is provided with a bore, said one of a ball and a pin disposed in said bore.

22. The hermetic compressor of claim 21, wherein said bore extends substantially radially from said drive shaft axis of rotation, and a said ball is disposed in said bore.

23. The hermetic compressor of claim 22, further comprising a plug disposed in said bore, movement of said ball radially away from said drive shaft being limited by said plug.

24. The hermetic compressor of claim 21, wherein said bore extends substantially perpendicularly relative to said drive shaft axis of rotation, and said pin is disposed in said bore.

25. The hermetic compressor of claim 24, wherein said pin is interference-fitted into said bore.

26. The hermetic compressor of claim 19, wherein said motor is disposed between said bearing and said compression mechanism.

27. A hermetic compressor assembly comprising:

a compressor housing;

a compression mechanism disposed in said housing;

a motor disposed in said housing;

a drive shaft operatively coupling said compression mechanism and said motor, said drive shaft having an outer surface in which a circumferential groove is provided, and an axis of rotation which is substantially horizontal;

a bearing disposed in said housing and fixed relative to said compression mechanism, said bearing disposed about said drive shaft, said bearing provided with a bore; and a ball retained in said bore, a portion of said ball being received in and engaging said circumferential groove, whereby relative movement of said compression mechanism and said drive shaft in both directions along said drive shaft axis of rotation is prevented.

28. A hermetic compressor assembly comprising:

a compressor housing;

a compression mechanism disposed in said housing;

a motor disposed in said housing;

a drive shaft operatively coupling said compression mechanism and said motor, said drive shaft having an outer surface in which a circumferential groove is provided, and an axis of rotation which is substantially horizontal;

a bearing disposed in said housing and fixed relative to said compression mechanism, said bearing disposed about said drive shaft, said bearing provided with a bore; and a pin extending through said bore, a portion of said pin being received in and engaging said circumferential groove, whereby relative movement of said compression mechanism and said drive shaft in both directions along said drive shaft axis of rotation is prevented.

29. A method of preventing oscillating axial movement of a substantially horizontal drive shaft in a hermetic compressor comprising:

forming a circumferential groove in the drive shaft;

rotatably supporting the drive shaft in a bearing;

forming a bore in the bearing;

inserting a retaining element into the bore; and engaging the bore and the circumferential groove each with a portion of the retaining element, whereby relative axial movement of the shaft and the bearing is prevented.

* * * * *